United States Patent [19]

Isaacson

[11] 4,343,105

[45] Aug. 10, 1982

[54] ENVELOPE-DISPLAY DEVICE AND METHOD

[75] Inventor: Robert Isaacson, Far Rockaway, N.Y.

[73] Assignee: Connecticut Valley Paper & Envelope Co., Inc., New York, N.Y.

[21] Appl. No.: 119,424

[22] Filed: Feb. 7, 1980

[51] Int. Cl.[3] ..... A47G 1/06; G09F 1/12

[52] U.S. Cl. ..... 40/155; 40/152.1; 248/459

[58] Field of Search ..... 40/152.1, 152, 155, 40/158 R, 158 B, 159, 124.1, 124.2, 124.4, 124, 10 D, 154, 360; 248/450, 455, 459, 461, 463, 472; 229/92.8, 92.3

[56] References Cited

U.S. PATENT DOCUMENTS

| | | | |
|---|---|---|---|
| 1,034,621 | 8/1912 | Jacobus | 40/152.1 |
| 1,359,662 | 11/1920 | Blyth | 248/459 X |
| 2,316,615 | 4/1943 | Piper | 40/154 X |
| 2,563,357 | 8/1951 | Nichols | 248/459 X |
| 2,731,748 | 1/1956 | Polay | 40/155 |
| 2,831,285 | 4/1958 | Cross | 40/152.1 |
| 2,919,512 | 1/1960 | McDonald | 40/152.1 |
| 3,966,161 | 6/1976 | Nichols | 248/459 |

FOREIGN PATENT DOCUMENTS

| | | | |
|---|---|---|---|
| 534444 | 1/1955 | Belgium | 40/152.1 |
| 400752 | 4/1966 | Switzerland | 40/124.1 |

*Primary Examiner*—Robert Peshock
*Assistant Examiner*—Michael J. Foycik
*Attorney, Agent, or Firm*—Curtis, Morris & Safford

[57] ABSTRACT

The display device includes an ordinary mailing envelope with a slot in the back. A stiff fiber-board card is inserted into the envelope. The card has a tab or tongue which is pushed outwardly through the slot in the back of the envelope to serve as a prop to support the envelope in the manner of a display card for counters or shelves in stores, etc. On the front of the envelope is printed the message to be displayed. Alternatively, the front of the envelope is fully or partially transparent, and photographs or other graphic matter are inserted into the envelope with the picture showing so that the display device serves as a relatively simple and low-cost picture frame.

13 Claims, 7 Drawing Figures

FIG. 1
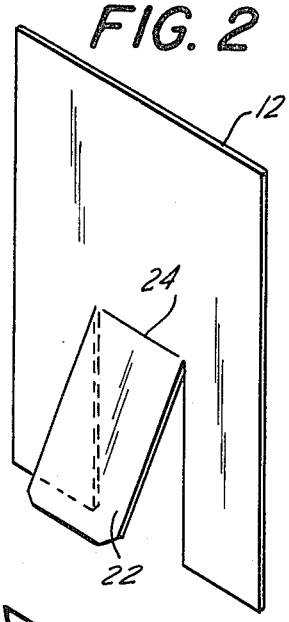
FIG. 2
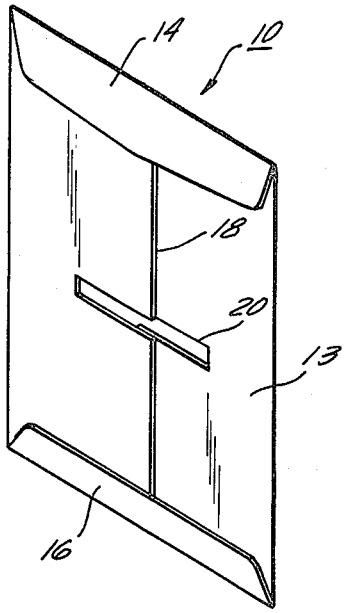
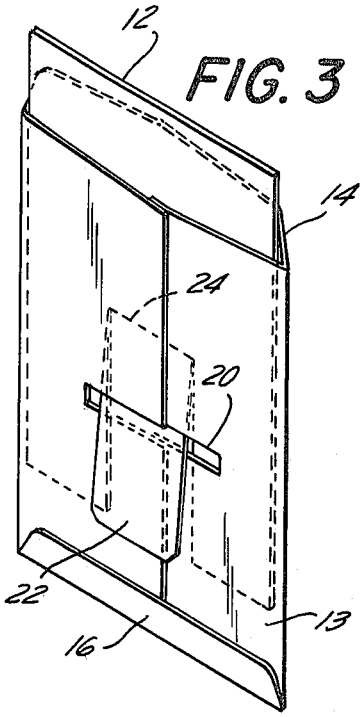
FIG. 3
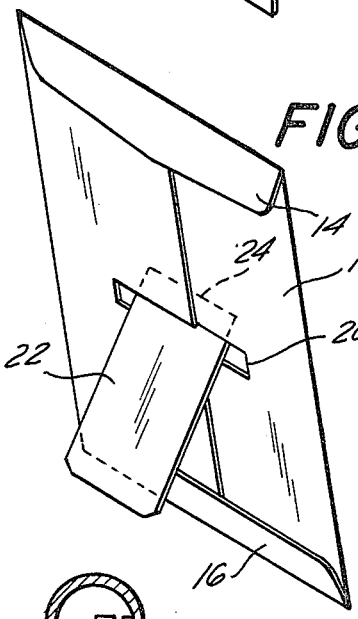
FIG. 4
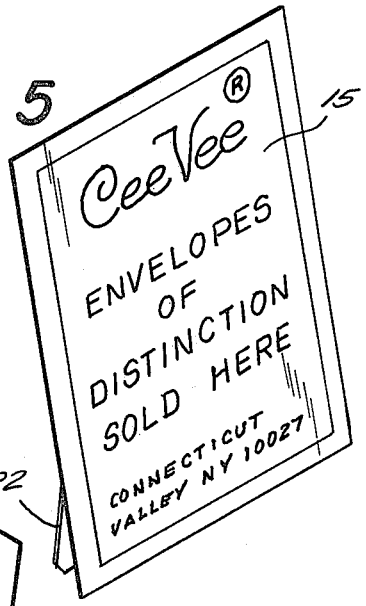
FIG. 5
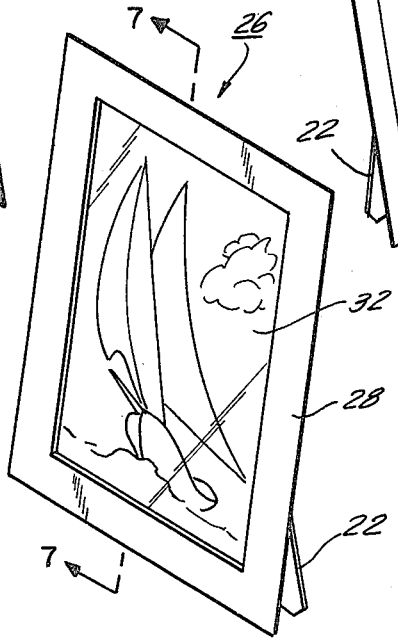
FIG. 6
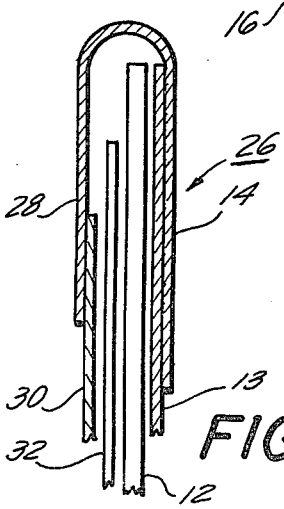
FIG. 7

ENVELOPE-DISPLAY DEVICE AND METHOD

The present invention relates to display devices and methods; that is, the invention pertains to devices for displaying messages, photographs, and other graphic matter on a support surface, and to methods of making such devices.

Display cards of many types have been made in the past. Typically, the display card is printed on stiff fiberboard, and a stiff prop is attached to the back of the card to enable the card to stand erect on the support surface.

The use of stiff fiberboard or card stock limits the choice of printing methods and/or quality of printing that can be used for printing prior display devices. One of the objects of the present invention is, therefore, to provide a display device which can be printed relatively easily, quickly, and by a wide variety of different printing methods, including low-cost printing methods, if desired.

Another object of the present invention is to provide a relatively low-cost display device and method for use in displaying photographs and other graphic matter.

In accordance with the present invention, the foregoing objects are met by the provision of a display device and method utilizing an envelope with a slot in the back, and a relatively stiff planar member which is inserted in the envelope. The planar member has a tab or tongue which extends outwardly through a slot in the back of the envelope to serve as a prop to support the envelope for use as a display card for counters or shelves in stores, etc. The message to be displayed appears on the front of the envelope. Alternatively, the front of the envelope can be fully or partially transparent, and photographs can be slipped into the envelope so that the display device serves as a relatively simple, low-cost, picture frame.

The foregoing and other objects and advantages of the invention will be set forth in or apparent from the following description and drawings. In the drawings:

FIG. 1 is a perspective view of a mailing envelope forming a component of the present invention;

FIG. 2 is a perspective view of an insert for the mailing envelope, providing another component of the present invention;

FIG. 3 is a perspective view showing the insert and the envelope partially assembled;

FIG. 4 is a perspective view showing the insert and the envelope fully assembled to form the display device;

FIG. 5 is a front perspective view showing the completed display device with the graphic matter on the front;

FIG. 6 is a perspective view of another embodiment of the present invention; and FIG. 7 is a cross-sectional, partially broken-away view taken along line 7—7 of FIG. 6.

Shown in FIG. 1 is a standard mailing envelope 10 having a rear wall 13, a front wall 15 (See FIG. 5), a lower flap 16, a closing flap 14, and a vertical seam 18. Also included is a horizontal opening 20 in the rear wall 13, located approximately midway between the top and the bottom edges of the envelope 10, as it is illustrated in FIG. 1.

FIG. 2 shows a relatively stiff, planar insert member or card 12 made out of cardboard of other fiber-board. The card 12 is die-cut along two vertical lines to form a tab or tongue 22 which is bent slightly at a line 24 approximately midway between the top and bottom of the member 12.

In forming the display device of the present invention, the card 12 is inserted into the envelope, in the manner shown in FIG. 3, so that the tongue 22 extends through the slot 20 and outside of the envelope. Then, as it is shown in FIG. 4, the flap 14 is sealed, and the extending tongue 22 serves as a prop to support the device on a flat surface for display purposes. Preferably, the fold-line 24 for the tongue 22 is slightly above the upper edge of the slot 20, as it is shown in FIG. 4, in order to provide extra support for the tongue when it is being used as a prop. This minimizes the chance that the tongue 22 will collapse and cause the display to fall down.

As it is shown in FIG. 5, the front surface 15 of the envelope is printed with a display message. In the particular example shown in FIG. 5, the message is an advertising message.

The display device has a number of advantages. One advantage is that it usually is much easier to print on an envelope than to print on a stiff card or fiber-board stock. Furthermore, the printing can be done at a lower cost, and with good quality.

If desired, a vertical slot can be used in addition to or instead of the horizontal slot in the back of the envelope, in order to accommodate tongues or props of different shapes.

Another embodiment of the invention is shown in FIGS. 6 and 7. This embodiment is identical to that shown in FIGS. 1 through 5, except that the front of the envelope has a transparent panel forming a window 30, and a photograph 32 is inserted between the transparent panel and the card 12 so that it can be seen as shown in FIG. 6. Thus, the display device 26 shown in FIGS. 6 and 7 constitutes a low-cost, convenient picture frame or display for pre-printed sheets of graphic material.

The paper envelope forms a border 28 for the transparent window 30. This border can be given a gold or other attractive color in order to form a colored frame for the picture or other graphic material 32. The window material can be cellophane or another plastic material.

It is preferred that the envelope, including the slot 20, be die cut. Similarly, it is preferred that the tab or tongue 22 be cut from a single sheet of cardboard material by die-cutting.

The size of the card 12 should be slightly less than the internal dimensions of the envelope, so that the card fits snugly into the envelope and gives it a neat, fully filled-out appearance.

The envelope itself can be made of a wide variety of materials. However, materials suitable for good quality printing are preferred, if the front of the envelope is to be printed upon.

The envelope-display device and method described above fully meet the objectives set forth at the beginning of the specification. The display device and method are relatively low-cost, simple to use, and the envelope is easily printable by a wide variety of printing techniques.

The above description of the invention is intended to be illustrative and not limiting. Various changes or modifications in the embodiments described may occur to those skilled in the art and these can be made without departing from the spirit or scope of the invention.

I claim:

1. A display device comprising an envelope consisting substantially entirely of relatively thin, flexible sheet material and having a substantially planar front sheet, a substantially planar rear sheet, said front and rear sheets being joined together along selected edges to form said envelope, an opening in said rear sheet, a relatively stiff planar member in the envelope, said member having a tongue extending outwardly through said opening to serve as a prop for the envelope.

2. A device as in claim 1 in which said front surface of said envelope is adapted to receive printing thereon.

3. A device as in claim 1 in which said front surface of said envelope has a transparent window for displaying graphic matter contained within said envelope.

4. A device as in claim 3 including an element bearing graphic matter to be displayed, said element being located between said window and said planar member.

5. A device as in claim 1 in which said planar member is a card, said tongue comprising a flap cut from the material of said card and forming a hinge with the body of said card at a location spaced inwardly from one edge of said card.

6. A device as in claim 1 in which said envelope includes top and bottom sealing flaps.

7. A device as in claim 1 in which said envelope consists of a single sheet of said material, which is folded over to form said front and back sheets, and to form end flaps, the edges of said single sheet being fastened together along a vertical seam, and at least one of said end flaps being folded over and sealed.

8. A method of making a display device, said method comprising the steps of making an envelope consisting substantially entirely of relatively thin, flexible sheet material and having a substantially planar front wall, a substantially planar back wall joined at selected edges to said front wall, said back wall having an opening in it, inserting a relatively stiff planar member into said envelope, said member having an outwardly-extending tongue, extending said tongue out of said envelope through said opening, and using said tongue as a prop to support said envelope erectly on a support surface.

9. A method as in claim 8 including the step of recording graphic matter on the front wall of said envelope, whereby said graphic matter is displayed for viewing.

10. A method as in claim 8 including the steps of providing said envelope with a transparent window in its front wall, and inserting a planar graphic matter-bearing element into said envelope between said planar member and said window with said graphic matter showing through said window.

11. A device as in claim 1 in which said tongue comprises a bent tab, said opening in said rear surface being a slot, the bend forming said tab being spaced upwardly from said slot so that the material of said envelope helps to brace said tab so as to resist collapse when used as a prop.

12. A device as in claim 1 in which said envelope is a mailing envelope which encloses said planar member substantially completely, except for said tongue, and the dimensions of said planar member being slightly less than the internal dimensions of said envelope so that said planar member fits snugly into said envelope.

13. A display device comprising a mailing envelope consisting of a single, relatively thin sheet of flexible material folded to form a substantially planar front wall, a substantially planar rear wall, a vertical seam at which edges of said sheet are fastened together, and end flaps, a slot in said rear wall, a flat card substantially filling said envelope, said card having a tab cut in the lower edge and bent outwardly along a fold line, with said tab extending through said slot out of said envelope, the fold line along which said tab is folded being above said slot when said tab is used as a prop to support said display device.

* * * * *